US009977382B2

(12) United States Patent
Ohta

(10) Patent No.: US 9,977,382 B2
(45) Date of Patent: May 22, 2018

(54) FIXING DEVICE

(71) Applicant: CANON KABUSHIKI KAISHA, Tokyo (JP)

(72) Inventor: Hideki Ohta, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days. days.

(21) Appl. No.: 14/948,062

(22) Filed: Nov. 20, 2015

(65) Prior Publication Data

US 2016/0154354 A1 Jun. 2, 2016

(30) Foreign Application Priority Data

Nov. 28, 2014 (JP) ..... 2014-242595

(51) Int. Cl.
*G03G 15/00* (2006.01)
*G03G 15/20* (2006.01)

(52) U.S. Cl.
CPC . *G03G 15/2089* (2013.01); *G03G 2215/2035* (2013.01)

(58) Field of Classification Search
CPC ... G03G 2215/2035; G03G 2215/2016; G03G 15/2053; G03G 15/2064; G03G 15/2039; G03G 15/2017
USPC ..... 399/328–330
See application file for complete search history.

(56) References Cited

U.S. PATENT DOCUMENTS 7,099,616 B2 * 8/2006 Kato ..... G03G 15/2053 219/216
2006/0086731 A1 * 4/2006 Shirakata ..... H05B 6/145 219/645
2013/0039683 A1 * 2/2013 Fujita ..... G03G 15/2053 399/329

FOREIGN PATENT DOCUMENTS

| | | | |
|---|---|---|---|
| JP | H096157 | A | 1/1997 |
| JP | H11143261 | A | 5/1999 |
| JP | 2006350002 | A | 12/2006 |
| JP | 2011075860 | A | 4/2011 |
| JP | 2012103433 | A | 5/2012 |
| JP | 2012252063 | A | 12/2012 |

* cited by examiner

*Primary Examiner* — Walter L Lindsay, Jr.
*Assistant Examiner* — Jessica L Eley
(74) *Attorney, Agent, or Firm* — Canon U.S.A., Inc. IP Division

(57) ABSTRACT

A fixing device includes a cylindrical film, a back-up member in contact with an inner surface of the film, a roller configured to form a fixing nip portion with the back-up member via the film, and a metal bearing configured to rotatably hold a shaft of the roller. The fixing device further includes an insulating portion provided between an end surface of the film and the bearing, thereby suppressing occurrence of leakage between the bearing and the end surface of the film.

14 Claims, 8 Drawing Sheets

FIXING DEVICE

BACKGROUND OF THE INVENTION

Field of the Invention

The present invention relates to a fixing device, which is mounted on a copier or a printer using an electrophotographic recording technique, and fixes an unfixed image formed on a recording medium, onto the recording medium.

Description of the Related Art

In recent years, a fixing device (hereinafter referred to as a "film fixing device") using a cylindrical film (belt) has become widespread. The film fixing device can have a smaller heat capacity, and thus have an advantage of being able to suppress power consumption. Many of the film fixing devices are configured to drive a roller in contact with an outer surface of the film, thereby rotatably driving the film. This is because such a configuration can simplify a structure. Such a configuration requires a back-up member disposed in contact with an inner surface of the film in a fixed manner, for pressing the film against the roller. In a film fixing device using a ceramic heater, this heater corresponds to the back-up member. Further, to reduce a rotational load of the film, grease is applied to the inner surface of the film. Meanwhile, components such as a roller are mounted in a U-shaped groove provided in a frame of the fixing device (see Japanese Patent Application Laid-Open No. 2011-75860).

In fixing devices, toner offset often occurs as a problem. As one of solutions to this problem, there is a fixing device that has a function of forming an electric field between a film surface and a roller surface using a direct-current power supply, so that the toner offset is suppressed by the action of the electric field. In this case, the film is provided with a conductive layer.

Meanwhile, if the film or roller is reduced in diameter to downsize the fixing device, the distance between a shaft (made of metal) of the roller and an end surface of the film becomes small. It is also conceivable that leakage may occur between the shaft (made of metal) of the roller or a metal bearing, and the end surface of the film, because a high voltage is applied between the film and the roller to suppress the toner offset. In addition, the grease applied to the inner surface of the film may protrude from the end surface of the film. The protruding grease may further reduce the distance relative to the shaft of the roller or to the bearing, and the leakage may occur more easily if the grease is conductive. If the leakage occurs, a potential difference between the film and the roller (a pressure roller) disappears, which reduces an effect of suppressing the offset.

SUMMARY OF THE INVENTION

The present invention is directed to a fixing device capable of suppressing the above-described leakage phenomenon.

According to an aspect of the present invention, a fixing device includes a cylindrical film, a back-up member in contact with an inner surface of the film, a roller configured to form a fixing nip portion with the back-up member via the film, a metal bearing configured to rotatably hold a shaft of the roller, and an insulating portion provided between an end surface of the film and the bearing.

According to another aspect of the present invention, a fixing device includes a cylindrical film, a back-up member in contact with an inner surface of the film, a roller having a metal shaft and configured to form a fixing nip portion with the back-up member via the film, and an insulating portion provided between an end surface of the film and the shaft of the roller.

Further features of the present invention will become apparent from the following description of exemplary embodiments with reference to the attached drawings.

DESCRIPTION OF THE EMBODIMENTS

Figure 1A:
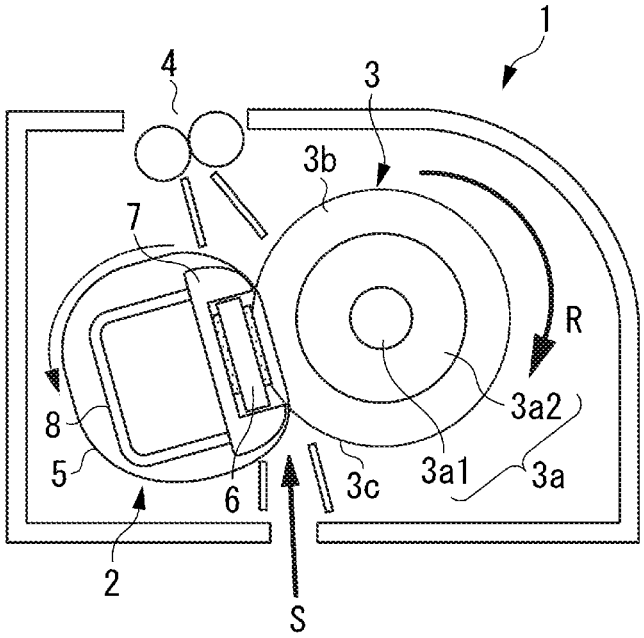
FIGS. 1A and 1B are a cross-sectional view of a fixing device and a cross-sectional view of a film, respectively.
Figure 1B:
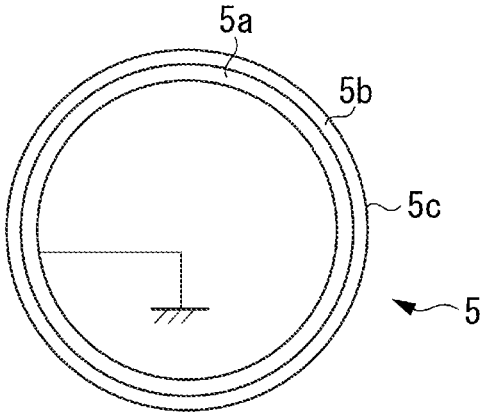
Figure 2:
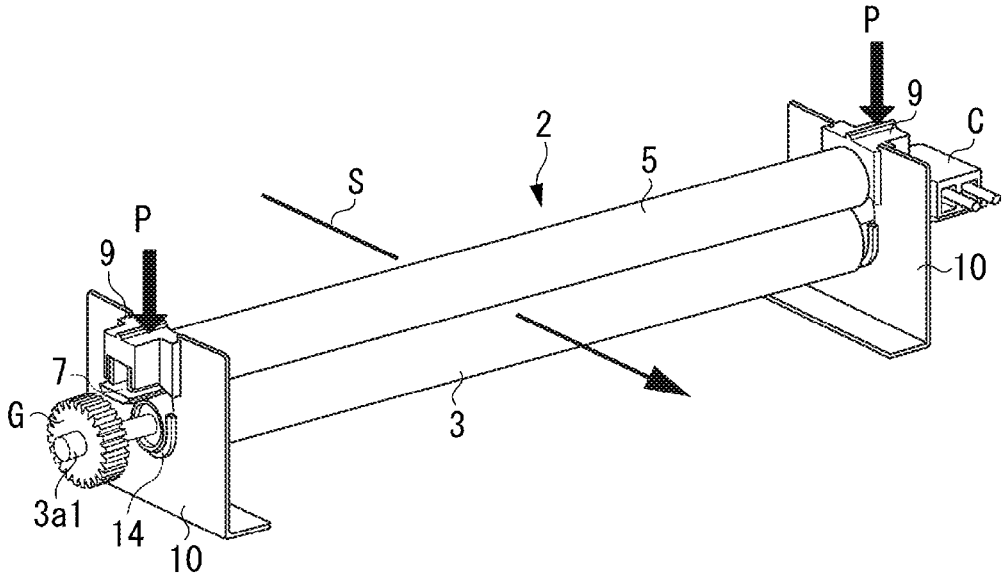
FIG. 2 is a perspective view of the fixing device.
Figure 3:
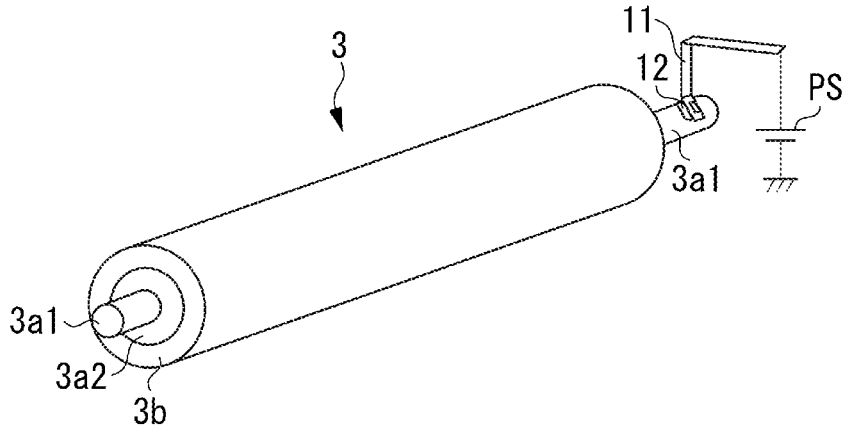
FIG. 3 is a view illustrating a configuration for applying a bias to a roller.

First, a brief overview of a fixing device 1 will be described with reference to FIGS. 1A to 3. FIG. 1A is a cross-sectional view of the fixing device 1, and FIG. 1B is a cross-sectional view of a cylindrical film. FIG. 2 is a perspective view of the fixing device 1. FIG. 3 is a view illustrating a configuration for applying a bias to a roller.

As illustrated in FIGS. 1A, 1B, and 2, the fixing device 1 has a heating unit 2, a roller 3, a conveyance roller 4, a device frame 10, and the like. The heating unit 2 has a cylindrical film 5, a heater 6 in contact with an inner surface of the film 5, a heater holder 7 for holding the heater 6, and a stay 8 for reinforcing the heater holder 7. The heating unit 2 further has a regulating member 9 for regulating a lateral shift of the film 5 in a thrust direction. The heater 6 serves as a back-up member. The heater 6 according to a first exemplary embodiment is a ceramic heater formed by printing a heat generation resistor on a ceramic substrate. A connector C for supplying power is attached to the heater 6, and the heater produces heat by receiving alternating-current power supplied from a commercial power supply via the connector C. The heater holder 7 is made of heat-resistant resin, and the stay 8 is made of metal. The heater 6, the heater holder 7, and the stay 8 are provided inside the film 5 in a generatrix direction of the film 5. Both ends of these components protrude from an end surface (a film end surface (or film end portion) 5*e* to be described below) of the film 5 (see FIG. 6A).

The film 5 has a base layer 5*a*, a rubber layer 5*b*, and a surface layer 5*c*. The base layer 5*a* is formed by dispersing carbon in a polyimide serving as a base material. The base layer 5*a* has conductivity. The rubber layer 5*b* is formed by dispersing carbon in silicone rubber serving as a base material. The rubber layer 5*b* also has conductivity. The surface layer 5*c* is formed of a tetrafluoroethylene-perfluoroalkyl vinyl ether copolymer (PFA), to have insulation properties.

The roller 3 forms a fixing nip portion with the heater 6 via the film 5. The roller 3 has a metal core 3*a*, a rubber layer 3*b*, and a surface layer 3*c*. The metal core 3*a* is made of iron (i.e., is conductive). The metal core 3*a* has a shaft 3*a*1 to which a gear G is attached, and a large diameter portion 3*a*2 coated with the rubber layer 3*b*. The rubber layer 3*b* is formed by dispersing carbon in silicone rubber serving as a base material. The rubber layer 3*b* also has conductivity. The surface layer 3*c* is formed of PFA, and has insulation properties.

The heating unit 2 and the roller 3 are mounted in a U-shaped groove 10*a* (see FIG. 5) provided in the metal frame 10 of the fixing device 1. As illustrated in FIG. 2, pressure P is applied to each of the regulating members 9 provided at both ends of the fixing device 1. The pressure P is exerted between the heater 6 and the roller 3 via the regulating member 9, the stay 8, and the heater holder 7. With such a configuration, the fixing nip portion is formed. A recording medium, on which an unfixed toner image is formed, passes through the fixing nip portion. When power is transmitted from a motor (not illustrated) to the gear G attached to the shaft 3*a*1, the roller 3 rotates in an arrow R direction, and the film 5 is driven to rotate according to this rotation. When the recording medium comes into a position between the film 5 and the roller 3, the recording medium is heated while being conveyed in an arrow S direction, so that the unfixed toner image formed on the recording medium is fixed onto the recording medium by heating.

Next, a configuration for suppressing toner offset will be described. As illustrated in FIG. 1B, the film 5 is electrically grounded via the base layer 5*a* having conductivity. Further, as illustrated in FIG. 3, the shaft 3*a*1 of the roller 3 is electrically connected to a direct-current power supply PS via a thin sheet 11 having conductivity and a carbon chip 12 in contact with the shaft 3*a*1. With such a configuration for applying a bias voltage, an electric field is formed between a surface of the film 5 and a surface of the roller 3 in a direction in which toner on the recording medium is pressed against the recording medium. Toner offset to the film 5 is suppressed by the action of this electric field.

Figure 4:
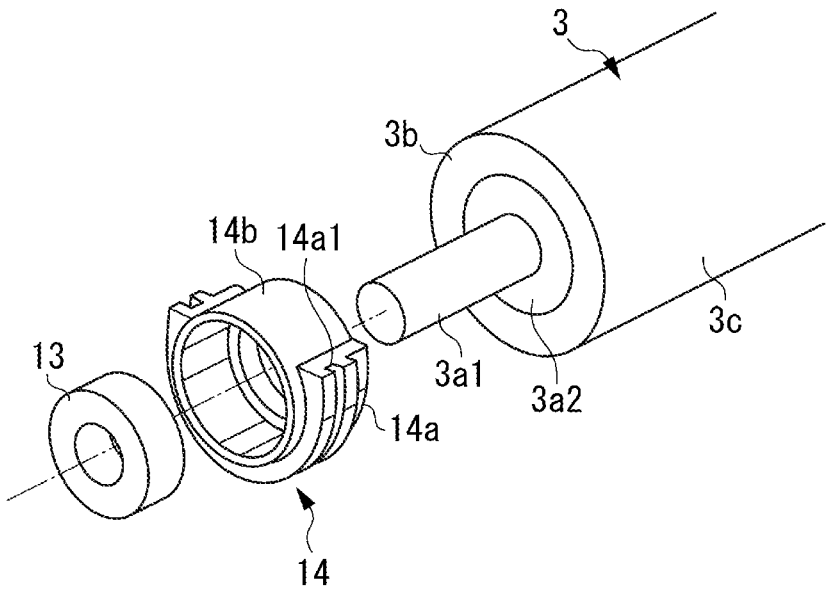
FIG. 4 is a perspective view illustrating an insulating member according to a first exemplary embodiment.
Figure 5:
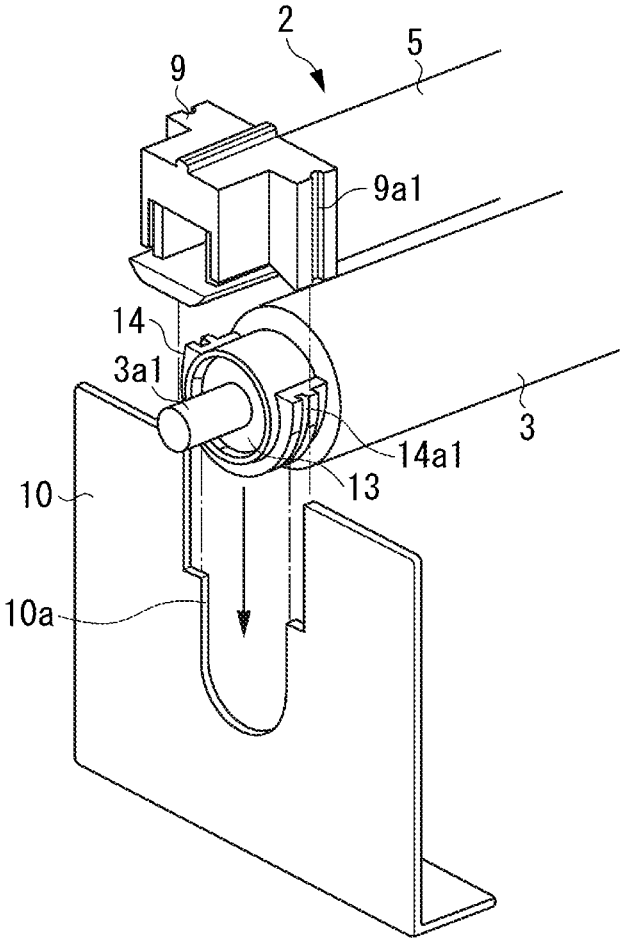
FIG. 5 is a view illustrating a structure for attaching each component to a device frame according to the first exemplary embodiment.
Figure 6A:
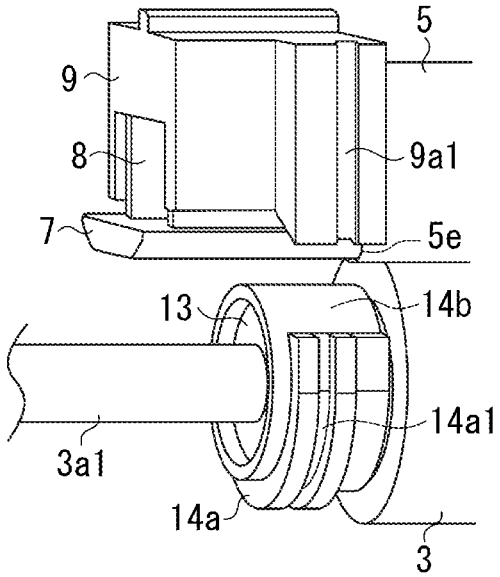
FIGS. 6A and 6B are views illustrating a relationship between a film end portion and an insulating portion according to the first exemplary embodiment.
Figure 6B:
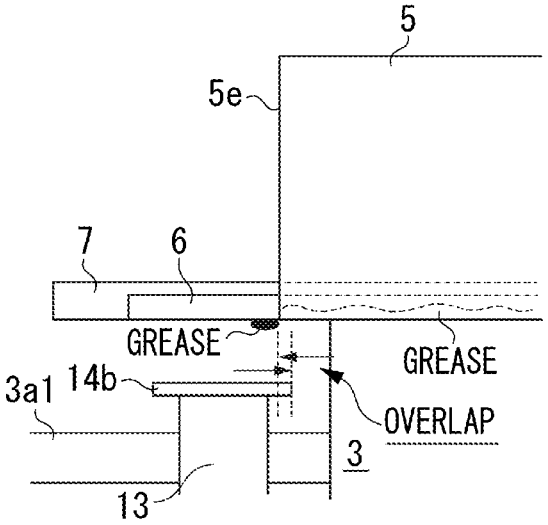

Next, a structure for holding the roller 3 will be described with reference to FIG. 4 to FIG. 6B. FIG. 4 is a perspective view illustrating an insulating portion (shielding portion) 14*b* to be described below. FIG. 5 is a view illustrating a structure for attaching each component to the device frame 10. FIGS. 6A and 6B are views illustrating a relationship between the film end portion 5*e* and the insulating portion 14*b*. The shaft 3*a*1 of the roller 3 is rotatably held by a metal bearing 13. A holder 14 formed of an insulating material holds the bearing 13. The roller 3 is rotatably held on the device frame 10 by mounting the holder 14 into the groove 10*a* of the frame 10 in an arrow direction illustrated in FIG. 5.

The holder 14 has a main body 14*a* and the shielding portion (insulating portion) 14*b* to be described below. The main body 14*a* has a groove 14*a*1 for inserting the holder 14 into the groove 10*a* of the frame 10. The regulating member 9 also has a groove 9*a*1 for inserting the regulating member 9 into the groove 10*a* of the frame 10. After the holder 14 is inserted into the groove 10*a* of the frame 10, the regulating member 9 is inserted into the groove 10*a* of the frame 10. The holder 14 is a resin component formed by integrally molding the main body 14*a* and the shielding portion 14*b*. The holder 14 according to the present exemplary embodiment is made of polyethylene terephthalate (PET).

Next, a leakage suppression configuration will be described. As illustrated in FIGS. 6A and 6B, in a state where the heating unit 2 and the roller 3 are attached to the frame 10, the insulating portion 14*b* is disposed between the end surface 5*e* of the film 5 and the bearing 13. The shielding portion 14*b* has insulation properties. Therefore, even if the metal bearing 13 is at a short distance from the end surface 5*e* of the film 5 having the base layer 5*a* and the rubber layer 5*b* that are conductive, occurrence of leakage therebetween can be suppressed. Meanwhile, grease is applied to the inner surface of the film 5. This grease may protrude from the end surface 5*e* of the film 5 as the fixing device 1 continues to be used. When the grease protrudes, a distance relative to the bearing 13 becomes short, and therefore leakage easily occurs if the grease is conductive. However, when the shielding portion 14*b* is disposed as in the present exemplary embodiment, leakage can be suppressed even if the grease protrudes. Further, in the present exemplary embodiment, as illustrated in FIG. 6B, the shielding portion 14*b* of the holder 14 and the film 5 overlap each other in an axial direction of the roller 3. Therefore, a configuration where leakage is less likely to occur can be achieved.

The shielding portion (insulating portion) 14*b* according to the present exemplary embodiment constitutes a part of the holder 14, and surrounds the entire bearing 13 in the circumferential direction of the bearing 13. However, as long as an insulating portion is disposed between the film end surface 5*e* and the bearing 13, the insulating portion may be a component independent of the holder 14, and may not necessarily surround the entire bearing 13 in the circumferential direction. Nevertheless, because the holder 14 and the regulating member 9 of the heating unit 2 are both attached to the frame 10, it is easy to achieve accuracy of a positional relationship between the holder 14 and the regulating member 9 (≈ a positional relationship between the holder 14 and the film end portion 5*e*). Therefore, it is preferable to provide the insulating portion as a part of the holder as in the present exemplary embodiment. This makes it easy to achieve accuracy of the position of the insulating portion relative to the position of the film end surface 5*e* and the position of the bearing 13.

Figure 7:
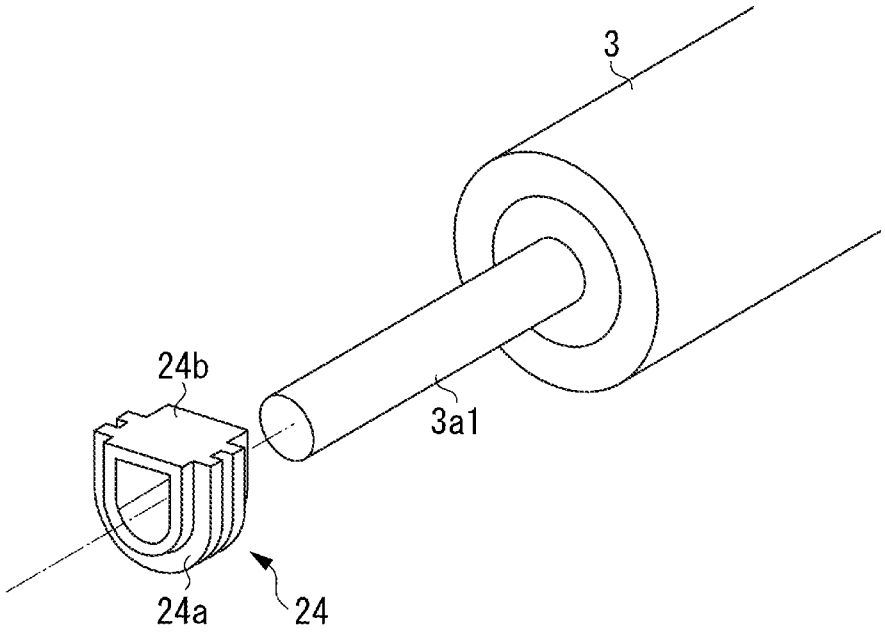
FIG. 7 is a perspective view illustrating an insulating portion according to a second exemplary embodiment.
Figure 8:
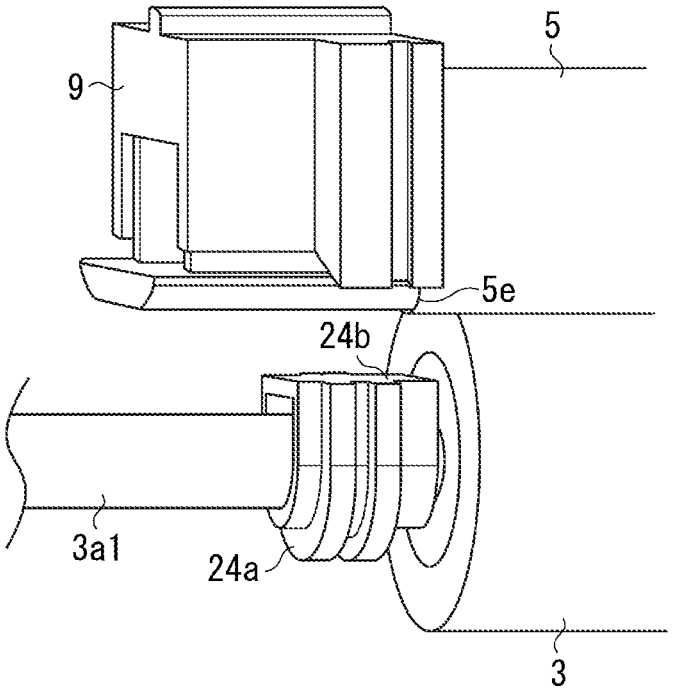
FIG. 8 is a view illustrating a relationship between a film end portion and an insulating portion according to the second exemplary embodiment.

FIGS. 7 and 8 illustrate a fixing device according to a second exemplary embodiment. The roller 3 of the present exemplary embodiment has the shaft 3*a*1 rotatably held by a slide bearing 24. The bearing 24 has a main body 24*a* and a shielding portion (insulating portion) 24*b*. The bearing 24 is a resin component formed by integrally molding the main body 24*a* and the shielding portion 24*b*. In a state where the roller 3 and the heating unit 2 are attached to the frame 10, the insulating portion 24*b* is disposed between the end surface 5*e* of the film 5 and the shaft 3*a*1 of the roller 3. The shielding portion 24*b* has insulation properties. Therefore, even if the metal shaft 3*a*1 is at a short distance from the end surface 5*e* of the film 5 having the base layer 5*a* and the rubber layer 5*b* that are conductive, occurrence of leakage therebetween can be suppressed.

In the first and second exemplary embodiments described above, the back-up member in contact with the inner surface of the film 5 is the heater 6. However, the back-up member is not necessarily a heater. The present invention is applicable to a fixing device in another configuration such as a configuration in which a film itself produces heat.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-242595, filed Nov. 28, 2014, which is hereby incorporated by reference herein in its entirety.

What is claimed is:

1. A fixing device for fixing an unfixed image formed on a recording medium, onto the recording medium while conveying the recording medium at a fixing nip portion, the fixing device comprising:

a cylindrical film;

a back-up member in contact with an inner surface of the film;

a roller configured to be in contact with an outer surface of the film and to form the fixing nip portion with the back-up member via the film;

a metal bearing configured to rotatably hold a shaft of the roller; and an insulating portion provided between an end surface of the film and the metal bearing, wherein a width of the insulation portion is larger than a width of the metal bearing in an axial direction of the roller, and wherein the end surface of the film is positioned inside an area where the insulating portion is provided in the axial direction of the roller.

2. The fixing device according to claim 1, wherein the insulating portion surrounds the entire bearing in a circumferential direction of the bearing.

3. The fixing device according to claim 2, wherein the bearing is held in a U-shaped groove of a frame of the fixing device via the insulating portion.

4. The fixing device according to claim 1, wherein the insulating portion is provided outside the film in the axial direction of the roller, and the film and the insulating portion overlap each other in the axial direction of the roller.

5. The fixing device according to claim 1, wherein a voltage is applied to the shaft of the roller.

6. The fixing device according to claim 1, wherein conductive grease is applied to the inner surface of the film.

7. The fixing device according to claim 1, wherein the back-up member is a heater.

8. A fixing device for fixing an unfixed image formed on a recording medium onto the recording medium while conveying the recording medium at a fixing nip portion, the fixing device comprising:

a cylindrical film;

a back-up member in contact with an inner surface of the film;

a roller having a metal shaft and configured to form the fixing nip portion with the back-up member via the film, wherein the roller is in contact with an outer surface of the film; and an insulating portion provided between an end surface of the film and the metal shaft of the roller, wherein the end surface of the film is positioned inside an area where the insulating portion is provided in an axial direction of the roller.

9. The fixing device according to claim 8, wherein the insulating portion surrounds the entire shaft in a circumferential direction of the shaft of the roller.

10. The fixing device according to claim 9, wherein the shaft of the roller is held in a U-shaped groove of a frame of the fixing device via the insulating portion.

11. The fixing device according to claim 8, wherein the insulating portion is provided outside the film in the axial direction of the roller, and the film and the insulating portion overlap each other in the axial direction of the roller.

12. The fixing device according to claim 8, wherein a voltage is applied to the shaft of the roller.

13. The fixing device according to claim 8, wherein conductive grease is applied to the inner surface of the film.

14. The fixing device according to claim 8, wherein the back-up member is a heater.

* * * * *